US008702066B2

(12) United States Patent
Steidinger et al.

(10) Patent No.: US 8,702,066 B2
(45) Date of Patent: Apr. 22, 2014

(54) DEVICE AND METHOD FOR CONTROLLING A PRESTRESSING JACK WHEN TENSIONING A TENDON

(75) Inventors: Peter Steidinger, Munich (DE); Oswald Nuetzel, Munich (DE); Hagen Keiner, Munich (DE)

(73) Assignee: Dywidag-Systems International GmbH, Munich (DE)

( * ) Notice: Subject to any disclaimer, the term of this patent is extended or adjusted under 35 U.S.C. 154(b) by 262 days.

(21) Appl. No.: 13/007,326

(22) Filed: Jan. 14, 2011

(65) Prior Publication Data

US 2011/0168960 A1 Jul. 14, 2011

Related U.S. Application Data

(63) Continuation of application No. PCT/EP2009/004780, filed on Jul. 2, 2009.

(30) Foreign Application Priority Data

Jul. 14, 2008 (DE) ..... 10 2008 032 881

(51) Int. Cl.
*E04C 5/08* (2006.01)
*B66F 3/24* (2006.01)

(52) U.S. Cl.
USPC ..... 254/228; 52/223.14

(58) Field of Classification Search
USPC ..... 254/199, 228; 73/826, 862.454, 862.42; 29/452; 52/223.13, 223.14, 223.1
IPC .... B25B 25/00; B21F 9/00; E04G 21/12; E04C 5/08; E01D 19/16; E21B 19/00
See application file for complete search history.

(56) References Cited

U.S. PATENT DOCUMENTS 3,090,598 A * 5/1963 Odilo ..... 254/29 A
3,176,961 A * 4/1965 Glass ..... 254/29 A
3,610,581 A * 10/1971 Paul ..... 254/29 A (Continued)

FOREIGN PATENT DOCUMENTS

DE 195 36 701 A1 4/1997
EP 0 421 862 A1 4/1991

(Continued)

*Primary Examiner* — Emmanuel M Marcelo
*Assistant Examiner* — Justin Stefanon
(74) *Attorney, Agent, or Firm* — Muncy, Geissler, Olds & Lowe, P.C.

(57) ABSTRACT

A device and a method for controlling a clamping press is provided when clamping a tension member as a function of the clamping force of a reference clamping member. The device has a hollow, cylindrical housing, wherein a piston coupled to the reference tension member is supported longitudinally displaceably along an axis. The housing and the piston encompass a pressure chamber that can be acted upon by a pressure medium for performing an axial stroke motion of the piston against the clamping force of the reference tension member by an inlet, and that can be connected by an outlet to the clamping press. The device further comprises a valve unit for controlling the application of the pressure medium to the clamping press, wherein the valve unit can be directly controlled by the stroke motion of the piston. The method according to the invention provides for clamping the tension member as a function of the clamping force of the reference tension member by the cylinder piston unit, the piston thereof holding the reference tension member in a predetermined stress state. When a uniform stress state is achieved in all tension members in the course of clamping the tension member by a clamping press, the inflow of the pressure medium to the clamping press is directly interrupted by the stroke motion of the piston.

19 Claims, 3 Drawing Sheets

(56) References Cited

U.S. PATENT DOCUMENTS

| | | | | | |
|---|---|---|---|---|---|
| 3,692,277 | A | * | 9/1972 | Schwartz et al. | 254/29 A |
| 4,485,677 | A | * | 12/1984 | Amelot et al. | 73/761 |
| 4,649,753 | A | * | 3/1987 | Goodsmith | 73/865.8 |
| 5,083,469 | A | * | 1/1992 | Percheron et al. | 73/862.42 |
| 5,431,659 | A | * | 7/1995 | Ross et al. | 606/103 |
| 5,718,090 | A | * | 2/1998 | Wei-Hwang | 52/223.14 |
| 5,809,710 | A | * | 9/1998 | Jungwirth et al. | 52/223.1 |

FOREIGN PATENT DOCUMENTS

| | | | |
|---|---|---|---|
| EP | 1 028 209 | A1 | 8/2000 |
| EP | 1 061 204 | A1 | 12/2000 |

* cited by examiner

DEVICE AND METHOD FOR CONTROLLING A PRESTRESSING JACK WHEN TENSIONING A TENDON

This nonprovisional application is a continuation of International Application No. PCT/EP2009/004780, which was filed on Jul. 2, 2009, and which claims priority to German Patent Application No. DE 10 2008 032 881.2, which was filed in Germany on Jul. 14, 2008, and which are both herein incorporated by reference.

BACKGROUND OF THE INVENTION

1. Field of the Invention

The present invention relates to a device and method for controlling a prestressing jack when tensioning a tendon.

2. Description of the Background Art

Devices in accordance with the invention are useful in all applications where at least two, but generally many, tension members of a structure are to be tensioned one after the other such that a uniform state of tension prevails in all tension members after the completion of the tensioning process. Cited by way of example are prestressed structures or structural members that, under the compressive preloading introduced during tensioning of the tendons, suffer elastic and plastic deformations, in particular compressions, which, when the tension members are successively tensioned individually or in groups, result in a reduction in the tensioning forces in each of the previously tensioned tension members, and thus result in nonuniform tension states. In order to achieve the result that all tension members have the same tensioning force in the final state, it is thus known to predetermine the sequence of tensioning, and to calculate precisely the tensioning forces to be introduced into each tension member, taking into account the deformation occurring in each case. Since the assumptions to be made for the deformations of the structure, in particular, are often uncertain, this resource-intensive process does not always result in a uniform distribution of tension.

An analogous situation results during the tensioning of free tension members, such as the cables for cable-stayed and suspension bridges. Such cables are generally composed of a plurality of individual tension members, for example steel wires, steel rods, or stranded steel wires, which must be tensioned in order to achieve the operational state. On the one hand, the tensioning force can be applied by tensioning all the individual elements simultaneously, although this proves to be very resource-intensive and cost-intensive on account of the large and correspondingly heavy prestressing jacks that are required here.

It is thus preferred, in contrast, to successively tension the individual tension members, although it is necessary to take into account during this process that the tensioning force of the previously tensioned individual tension members decreases with the tensioning of each [additional] individual tension member. In order to nevertheless obtain a uniform state of tension in all the individual tension members, it is thus necessary for all individual tension members except the last to be over-tensioned by a specific amount characteristic for each individual tension member.

An associated problem also exists in the field of geotechnical engineering, where ground anchors with one or more tension members are anchored within a drilled hole deep in the subsoil and are tensioned against an abutment on the exposed side of the drilled hole. Especially in the case of stepped anchors with tension members of different lengths, simultaneously tensioning all tension members by a uniform tensioning distance results in different states of tension, which is why the individual tension members are adjusted to a uniform load in the operational state through successive tensioning.

In this context, a tension member made of stranded steel wires is known from EP 0 421 862 B1, which corresponds to U.S. Pat. No. 5,083,469, and in which the first tensioned strand is used as a reference strand, and is provided with a force measuring device. Each additional strand is then to be tensioned to the tensioning force that the reference strand has at the time when the additional strand is tensioned. In this procedure, the tensioning force to be applied to the first strand is calculated at a value above the final tensioning force on account of the expected deformations of the structure. Since the tensioning force inherent in the strands that have been tensioned at any point is always the same in this method, the reference strand always reflects the current tensioning force in the individual strands. Consequently, changes in the deformation, for example due to temperature differences, do not affect the uniform state of tension. However, carrying out this method requires complex force measurement devices which must be installed before tensioning, observed during the tensioning process, and removed again afterwards.

A possibility for successive tensioning of tendons or individual elements of tension members that is improved in comparison is known from DE 195 36 701 A1, which corresponds to U.S. Pat. No. 5,809,710. Described there is a tensioning device with first and second prestressing jacks that are connected to one another through a tension line and a return line and that form a hydraulically communicating system. The tensioning of the reference tendon initially takes place solely with the first prestressing jack, bypassing the second prestressing jack. The subsequent tendons are then tensioned with the second prestressing jack until the beginning of a longitudinal motion in the reference tendon resulting from the uniform pressure in both prestressing jacks is discernible, signaling a uniform state of tension in the two tendons. In this way, all tendons can be tensioned gradually to the same tensioning force without the need to make cumbersome measurements.

SUMMARY OF THE INVENTION

It is therefore an object of the present invention to further simplify and to automate the process of tensioning tendons.

A first advantage of the invention results from the maximally automatic progress of the tensioning process. Once the reference tension member and the prestressing jack have been set up, there is no need for complex control devices or further actions on the part of the operating personnel, such as taking measurements or switching off the prestressing jack at the right time. The manual labor is essentially limited to switching the prestressing jack from one tension member to the next. Consequently, the invention makes it possible for tension members to be tensioned easily and quickly and also precisely and reliably, with minimal labor and expense.

In an embodiment, a valve unit is provided that is actuated as a function of the stroke motion of a piston and that controls the supply of pressure medium for the prestressing jack. In this regard, the invention encompasses all types of valves, of which that shown in the figures represents only one embodiment. This embodiment provides for arranging the valve unit in the pressure space—that is enclosed by the housing and piston—through which the pressure medium flows on the way to the prestressing jack. The piston motion interrupts this flow path with the aid of the valve, and thus stops the prestressing jack's tensioning process.

In an embodiment of the invention, the valve unit has a valve tappet that is directly connected to the piston, an effect which can also be achieved by a one-piece design of the piston and tappet. This results in a device that is extremely simple and compact and operates extremely precisely as a result of the transmission of force from the piston to the tappet without play. The precision, and hence the reliability, of the valve unit are further increased by the mounting of the valve tappet in an axial plain bearing at the end opposite the piston.

Additional advantages are achieved by the means that the reference tension member is anchored directly to the piston of the inventive device and additionally passes through it along its longitudinal axis. Overall, this results in an extremely compact construction, which is of great utility in view of the cramped conditions in the anchorage zone of the tension members.

In order to improve the functionality of an inventive device, said device can be expanded by means of a tensioning module that is interposed between the wedge plate and the piston, and with which the already prestressed reference tension member is additionally tensioned by a short distance in order to activate the wedge grip in the region of the anchorage of the reference tension member to the piston. This embodiment of the invention thus offers a maximum of efficiency and operating convenience.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
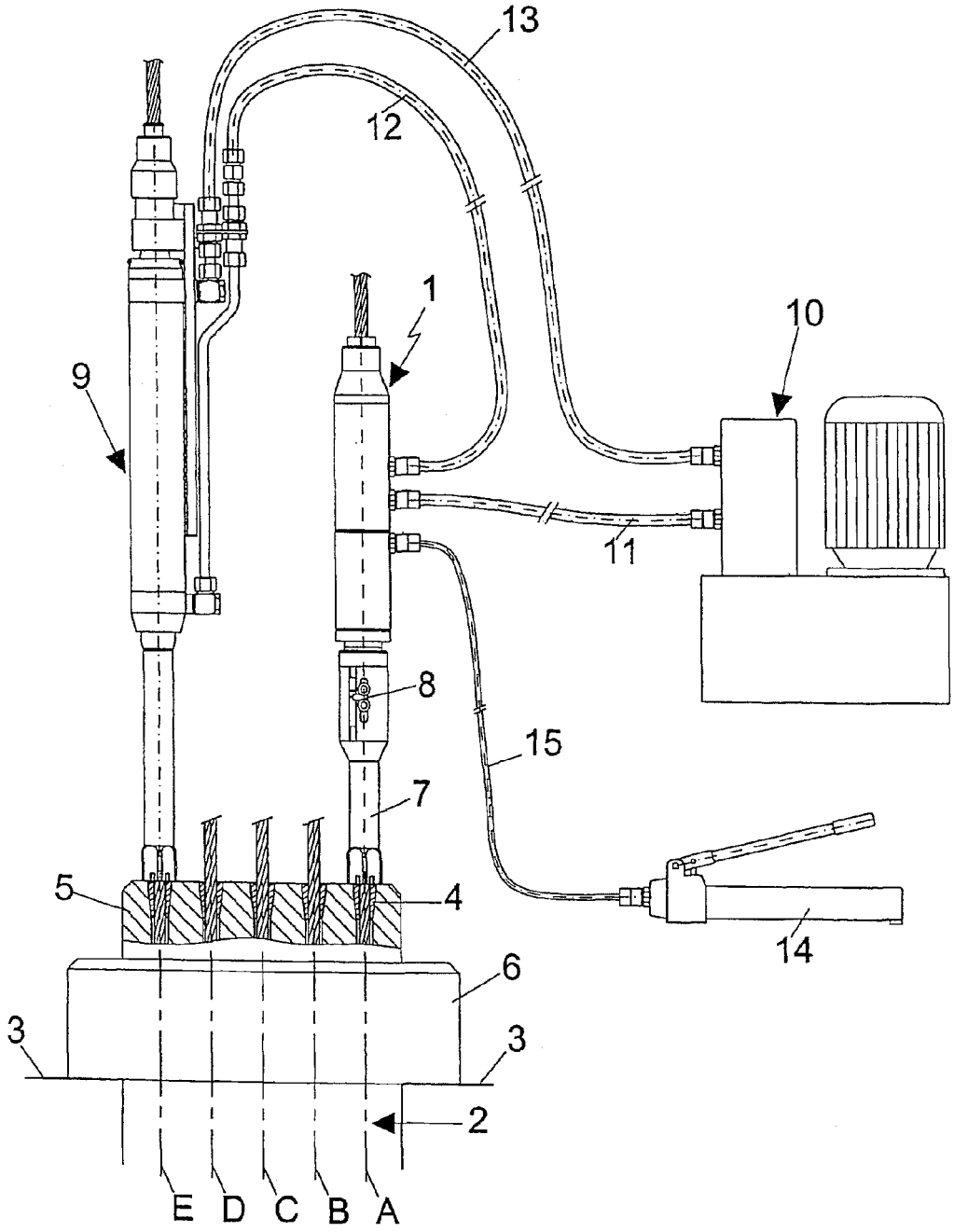
FIG. 1 shows an overview of a device for successive tensioning of tension members according to the invention.

FIG. 1 gives an overview of a device 1 according to the invention as well as its use in tensioning a multi-strand tendon 2. It can be seen that a prestressed structural member 3 in the anchorage zone of the multi-strand tendon 2 is merely indicated. The multi-strand tendon 2 is composed of a plurality of tension members, of which the tension members A, B, C, D, E are shown as representative for all tension members. The tension members A, B, C, D, E, here in the form of stranded wires, are secured in a known manner with the aid of anchoring wedges 4 in a wedge plate 5, which in turn is seated on an abutment ring 6 that bears against the structural member 3. In the present example, the strand A constitutes the reference tension member, whose tension is used as a reference for tensioning the remaining tension members B, C, D, E. The goal is to produce a uniform state of tension in all the individual tension members A, B, C, D, E for the operational state when tensioning the multi-strand tendon 2.

The requisite equipment for this includes a device 1 according to the invention, whose precise structure will be described in detail with reference to FIG. 2 through 4. The device 1 according to the invention is slid onto the free end of the reference tension member A, with an adapter 7 that bears against the wedge plate 5 being interposed. Integrated in the adapter 7 is an indicator device 8 that makes visible the longitudinal motions of the free end of the reference tension member A relative to the wedge plate 5.

A prestressing jack 9 is slid onto the part of the tension member E to be tensioned that extends beyond the wedge plate 5; the base of the prestressing jack also bears against the top of the wedge plate 5. The prestressing jack 9 is known per se and is pressurized with pressure medium through a hydraulic system in order to be able to carry out the tensioning process.

The hydraulic system includes a pump 10, which is connected to the device 1 according to the invention by a supply line 11. From there, a connecting line 12 leads to the prestressing jack 9, whence the pressure medium is carried through a return line 13 back to the pump 10, and thus in a circuit. The use of the inventive device 1 ensures that the tensioning of the tension member E proceeds only until a state of tension comparable to the state of tension of the reference tension member A is reached.

Also visible in FIG. 1 is a pump 14, which is connected through the pressure line 15 to the device 1, and with which pressure can be applied to the device 1 independently of the above-described hydraulic system, a feature that will be described in detail below.

Figure 2:
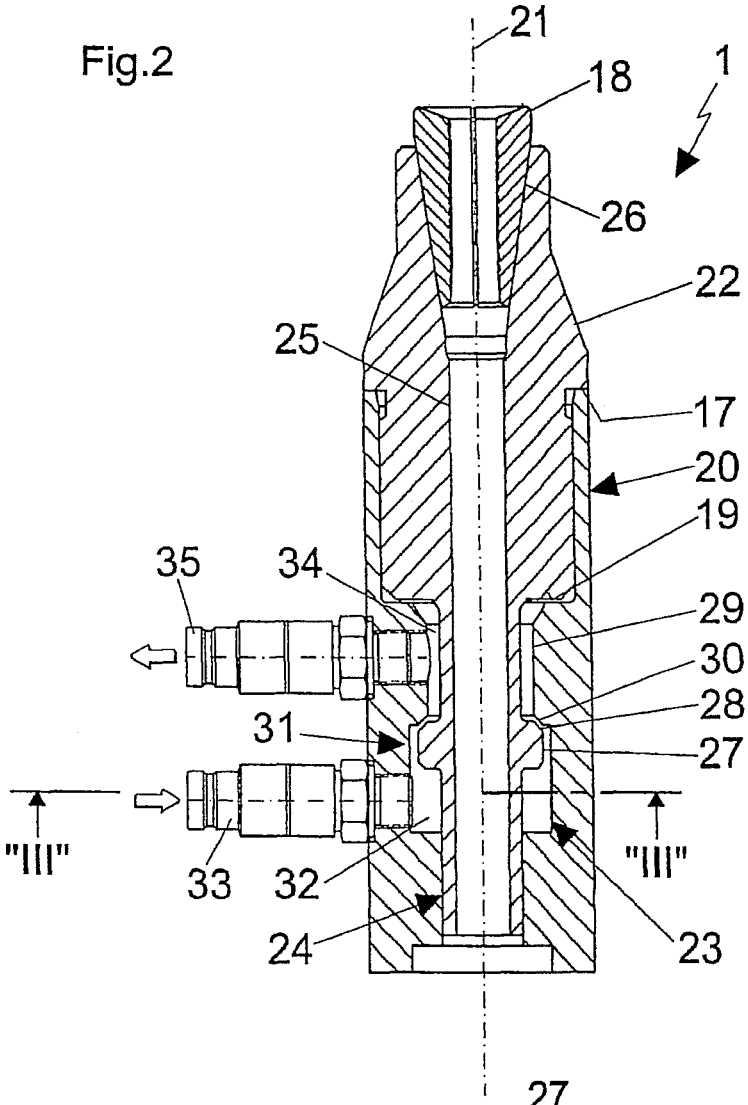
FIG. 2 shows a longitudinal section through a first embodiment of a device according to the invention along the line II-II shown in FIG. 3.
Figure 3:
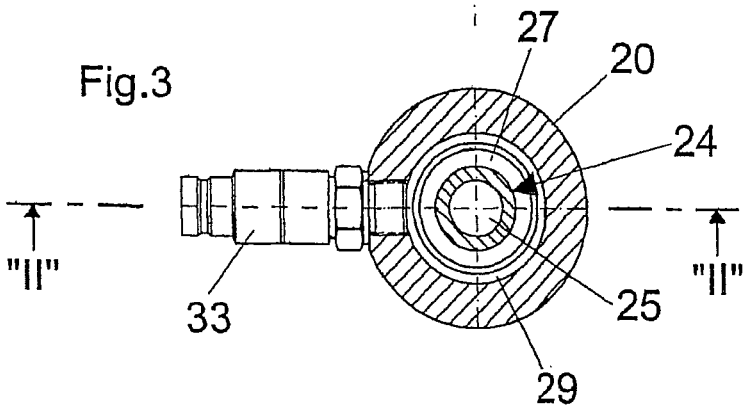
FIG. 3 shows a cross-section through the device shown in FIG. 2 along the line III-III therein.

FIGS. 2 and 3 show the construction of a device 1 according to the invention in detail. Visible here is a housing 20 in the form of a hollow, circular cylinder with a longitudinal axis 21 that coincides with the longitudinal axis of the reference tension member A during tensioning. The housing 20 is open at both ends, and encloses a hollow space that serves to accommodate a piston 22 in the section at the top in the drawing, and in which is formed a pressure space 23 in the adjacent section below.

The piston 22 is supported in the housing 20 such that it is longitudinally displaceable and liquid-tight with respect to the inner wall of the housing 20, and has, at its part projecting past the end of the housing 20, a stepped circumferential enlargement 17 that, together with the end of the housing 20, forms a stop for limiting the piston motion.

The end of the piston 22 located within the housing 20 is delimited by a piston surface 19, from which an internal tappet 24 extends coaxially. The piston 22 and internal tappet 24 are thus a one-piece component. The end of the housing 20 at the bottom in the illustration constitutes a bearing region for accommodating the free end of the internal tappet 24 in a longitudinally displaceable manner. A through-hole 25 extends along the longitudinal axis 21 through both the internal tappet 24 and the piston 22, wherein the through-hole 25 enlarges conically in the region of the outer end of the piston 22 in order to form receptacles 26 for the clamping jaws 18 of an anchoring wedge.

In the center region of the pressure space 23, the internal tappet 24 bears an annular collar 27 which is coaxial to the longitudinal axis 21 and whose top annular edge is chamfered to form a first sealing surface 28. Radially opposite the annular collar 27 at an angle, a concentric annular shoulder 29 extending around the inner circumference of the housing 20 can be seen, whose edge located axially opposite the sealing surface 28 is likewise chamfered and constitutes a second sealing surface 30. In this way, the internal tappet 24 and the housing 20 together form a valve unit 31 in which the valve seat is formed by the annular shoulder 29 with the second sealing surface 30 and the shutoff element is formed by the annular collar 27 with the first sealing surface 28. The valve opening results from the conical annular gap between the two sealing surfaces 28 and 30.

The valve unit 31, more precisely its valve opening, subdivides the pressure space 23 into a first pressure chamber 32, located at the bottom in the drawing, into which opens the inlet 33, which in turn is connected to the supply line 11 coming from the pump 10, and a second pressure chamber 34 at the top, from which leads an outlet 35 that is connected to the prestressing jack 9 through the connecting line 12.

In preparation for the tensioning process, the device 1 is slid over the free end of the reference tension member A projecting from the wedge plate 5, wherein the reference tension member A comes to rest within the through-hole 25. Once the end of the device 1 rests against the wedge plate 5, the reference tension member A is slightly overtensioned and is fastened at the other end of the device 1 in the piston 22 by means of the clamping jaws 18. The actual tensioning process for the tension members B, C, D, E is described later.

Figure 4:
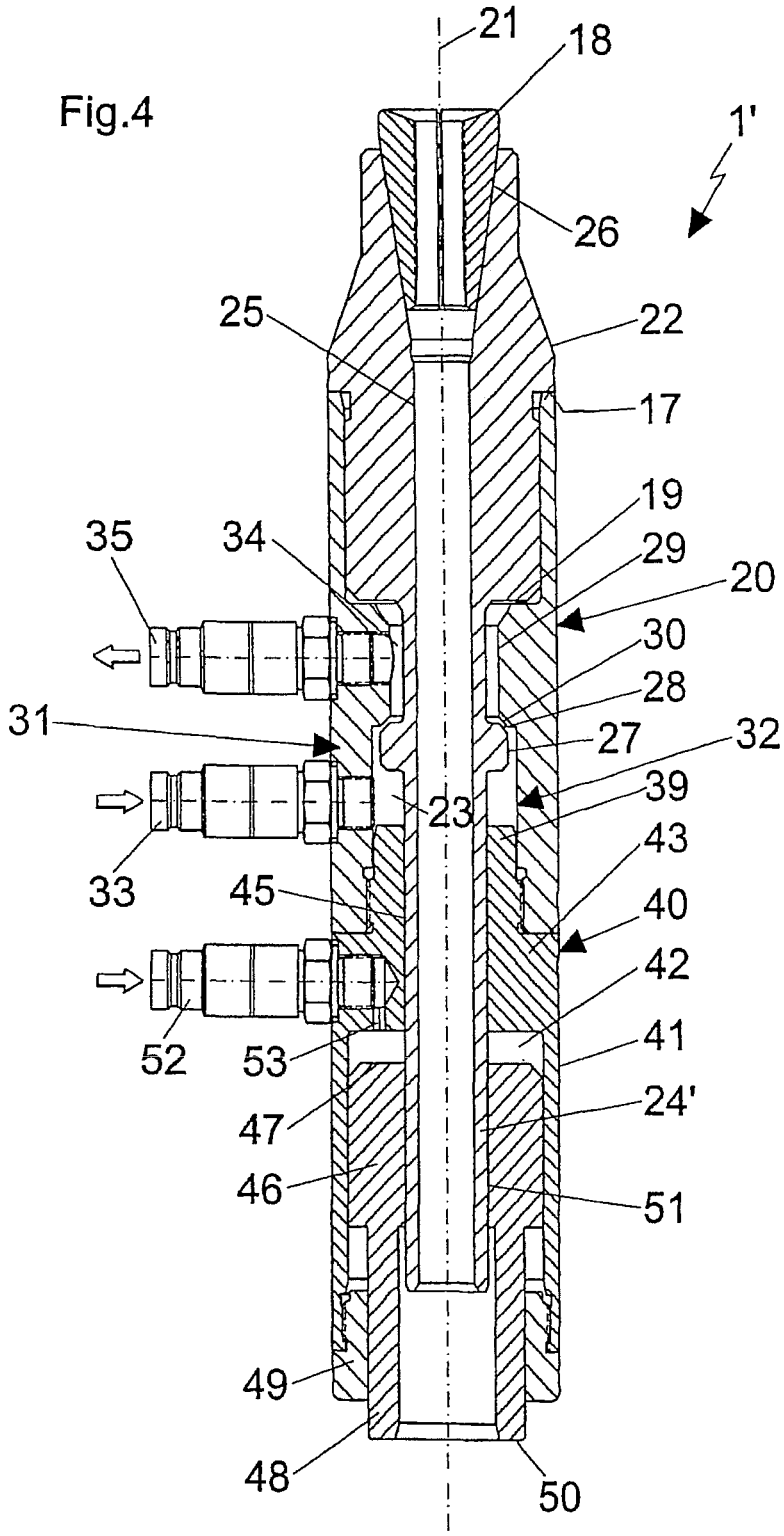
FIG. 4 shows a longitudinal section through a refinement of the device shown in FIG. 1.

The device 1' shown in FIG. 4 concerns a refinement of the invention in which the connecting region to the wedge plate 5 is further developed. Otherwise, the device 1' corresponds to the device 1 described in relation to FIG. 2, so identical reference symbols are used for identical parts and reference is made to the part of the description there in order to avoid repetition. Similar parts with equivalent function are marked with the superscript "'".

The device 1' shown in FIG. 4 is augmented by a tensioning module 40 whose function is to tension the reference tension member A by a short distance to activate the clamping action of the clamping jaws 18 in the receptacles 26 of the piston 22 prior to the actual tensioning of the tension members B, C, D, E. In a device 1 as shown in FIG. 2, the absolute frictional connection between reference tension member A and the device 1 must be ensured by other means.

The tensioning module 40 comprises a hollow cylindrical housing 41 that encloses a pressure space 42, which is closed at its top end in the drawing by a thick-walled end wall 43. Formed on the end wall 43 is a coaxial threaded stem 39 with a reduced diameter as compared to the housing 41, which is screwed into the bottom housing opening for connection to the bottom end of the housing 20. A through-hole 45 that is coaxial to the longitudinal axis 21 and accommodates the elongated end of the internal tappet 24' in a longitudinally displaceable manner is made in the end wall 43 and the threaded stem 39.

Arranged in the pressure space 42 is a cylindrical piston 46 that is longitudinally displaceable therein, and that delimits the pressure space 42 with its piston surface 47. The underside of the piston 46 opposite the piston surface 47 is composed of a cylindrical pressure foot 48, which in turn is supported in a bearing ring 49 that terminates the housing 41. The section of the pressure foot 48 projecting past the bearing ring 49 has, at its end, a support surface 50 which bears indirectly against the wedge plate 5 through the adapter 7. The piston 46 and pressure foot 48 have a through-hole 51 concentric to the longitudinal axis 21 in which the end of the elongated internal tappet 24' is supported.

For pressurizing the pressure space 42 with a pressure medium, an inlet 52 is provided that is introduced radially into the end wall 44 and is connected to the pressure space 42 through an axial hole 53. In this way, a stroke motion of the piston 42 along the longitudinal axis 21 is initiated by introducing a pressure medium through the inlet 52.

The inventive tensioning process can then be structured as follows:

In the initial situation for the tensioning process, the tension members A, B, C, D, E are inserted in the structural member 3, are partially prestressed as appropriate, and are provisionally anchored in the wedge plate 5 with the aid of the anchoring wedges 4, wherein the free ends of the tension members A, B, C, D, E project generously beyond the anchorage zone. In order to prestress the tension members A, B, C, D, E to a uniform load for the operational state, the reference tension member A is first prestressed to a computationally predetermined value with the aid of the prestressing jack 9, which later will also be used for the other tension members B, C, D, E, and is anchored.

Then the prestressing jack 9 is removed from the reference tension member A and the adapter 7 is slid onto the reference tension member A. The adapter 7 has a hollow cylindrical part with an indicator device 8 whose pointer can be frictionally connected to the reference tension member A.

Next, an inventive device 1 or 1' as shown in FIG. 2 or 4 is slid onto the reference tension member A and the adapter 7. In this way, the reference tension member A comes to rest within the through-hole 25 and is secured in the piston 22 by means of the clamping jaws 18. With the aid of the pump 14 (FIG. 1), which is connected to the inlet 52, the pressure space 42 is then pressurized with pressure medium, wherein the pressure foot 48 of the piston 46 bears against the wedge plate 5 via the adapter 7, and thus moves the piston 22 through the housings 41 and 20 in opposition to the tensioning force when the tensioning force of the reference tension member A is exceeded. The piston stroke is indicated by the indicator device 8. In this process, the clamping jaws 18 are pressed radially inward by the conical receptacles 26 in a known manner, with the teeth located on the inside of the clamping jaws 18 that are in contact with the reference tension member A firmly gripping the reference tension member A.

As soon as this state has been reached, a shutoff valve on the pump 14 can be closed so that the full tensioning force of the reference tension member A is now carried through the piston 22 that bears against the housing 20.

Now, in another step, the prestressing jack 9 is slid onto the next tension member to be prestressed, for example tension member E, the reference tension member E is anchored to the movable piston of the prestressing jack 9, and both the prestressing jack 9 and the device 1' according to the invention are connected by the lines 11, 12, and 13 to the hydraulic system. This state is shown in FIG. 1.

After that, the prestressing jack 9 is pressurized with a pressure medium, which comes from the pump 10 through the inlet line 11 to reach the first pressure chamber 32 and flows through the valve opening into the second pressure chamber 34, whence it reaches the prestressing jack 9 through the outlet 35 and the connecting line 12, where it acts upon the movable piston of a piston/cylinder unit.

As the piston stroke progresses during the tensioning process, a further tensioning of the tension member E can only be achieved by raising the operating pressure in the hydraulic system. In so doing, a boundary state is established at the end of the tensioning process in which the pressure in the prestressing jack 9 corresponds to the pressure in the pressure space 23. This state is thus distinguished by the fact that the piston of the prestressing jack 9 and the piston 22 of the device 1' in accordance with the invention are both pressurized to the same pressure. Since the area of the piston of the prestressing jack 9 corresponds to the piston surface 19, a uniform state of tension of the two tension members A and E is achieved in this way.

As a result of a further pressure increase during the course of tensioning the tension member E, the pressure medium acting on the piston surface 19 causes a stroke of the piston 22 in opposition to the tensioning force of the reference tension member A, with the internal tappet 24' also being raised on account of the design. In this process, the sealing surface 28 of the annular collar 27 comes into contact with the sealing surface 30 of the annular shoulder 29, so that the valve opening is closed and thus the further supply of pressure medium to the second pressure chamber 34 and thence to the prestressing jack 9 is stopped.

In order to reliably hold the valve unit 31 in the closed position, the pressure of the pressure medium is increased further, for example by 30 to 50 bar. As a result of the closed valve position, this pressure increase acts only on the chamber 32, where the pressure medium acts on the bottom annular surface of the annular collar 27 in the axial direction, and thereby pushes the internal tappet 24, 24' upward and thus presses the sealing surface 28 axially against the valve seat.

After the tension member E has been anchored in the wedge plate 5, the prestressing jack 9 can be removed from the tension member E and can be switched to the next tension member B, C, D, and the tensioning process can be repeated.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for controlling a prestressing jack during tensioning of a tension member as a function of a tensioning force of a reference tension member, the device comprising:

a hollow cylindrical housing in which a piston coupled to the reference tension member is mounted to be longitudinally displaceable along an axis;

a pressure space formed by an enclosure of the housing and the piston, the pressure space being adapted to be pressurized with a pressure medium through an inlet in order to carry out an axial stroke motion of the piston in opposition to the tensioning force of the reference tension member and that is connectable to the prestressing jack through an outlet;

a valve unit configured to control a pressurization of the prestressing jack with the pressure medium, wherein the valve unit is controllable directly by the stroke motion of the piston and a component for anchoring the reference tension member, a portion of the component having a conical shaped outer surface, the conical shaped outer surface portion being provided within the piston, wherein the piston has an axial through-hole for passage of the reference tension member.

2. The device according to claim 1, wherein the pressure space is subdivided into a first pressure chamber that is connectable to the inlet and a second pressure chamber that is connectable to the outlet, wherein the valve unit is arranged between the first pressure chamber and the second pressure chamber.

3. The device according to claim 1, wherein the valve unit comprises a valve seat located on the housing and a valve tappet that cooperates therewith when the valve unit is closed and that is coupled to the motion of the piston to actuate the valve unit.

4. The device according to claim 3, wherein the valve tappet is rigidly connected to the piston.

5. The device according to claim 4, wherein the housing has, at each axial end thereof, a plain bearing in which the piston or wherein the valve tappet is supported in a liquid-tight manner.

6. The device according to claim 3, wherein the valve tappet has an annular collar with a sealing surface that works together with a sealing surface that is parallel thereto and comprises an annular shoulder extending around the inner circumference of the housing in order to close the valve unit.

7. The device according to claim 6, wherein the sealing surface is tapered so as to be arranged at an oblique angle to the axis.

8. The device according to claim 3, wherein the valve tappet has an axial through-hole for passage of the reference tension member.

9. The device according to claim 3, wherein the housing has an additional pressure space in which is mounted, in a longitudinally displaceable manner, an additional piston that is subjected to a pressure medium to execute a stroke motion, wherein the additional piston bears against an anchorage zone of the reference tension member in order to initiate a motion of the housing in opposition to the tensioning force of the reference tension member.

10. The device according to claim 9, wherein the additional pressure space is pressurized by a pump.

11. The device according to claim 10, wherein the additional piston has an axial through-hole for passage of the reference tendon.

12. The device according to claim 11, wherein the valve tappet is arranged to be longitudinally displaceable in the through-hole of the additional piston.

13. The device according to claim 9, further comprising an indicator device, which indicates the stroke motion of the additional piston.

14. The device according to claim 13, wherein the indicator device is arranged on an adapter.

15. The device according to claim 13, wherein the indicator device has a pointer that is frictionally connected to the reference tension member.

16. The device according to claim 3, wherein the valve tappet is monolithically connected to the piston.

17. The device according to claim 3, further comprising a second housing that includes an additional pressure space in which is mounted, in a longitudinally displaceable manner, an additional piston that is subjected to a pressure medium to execute a stroke motion, wherein the additional piston bears against an anchorage zone of the reference tension member in order to initiate a motion of the housing in opposition to the tensioning force of the reference tension member.

18. The device according to claim 1, wherein the component comprises a conical receptacle and clamping jaws arranged in a complementary shape therein.

19. The device according to claim 1, wherein the piston includes a first end where the reference tension member is initially inserted into the axial through-hole and a second end that opposes the first end, and wherein the component for anchoring the reference tension member is provided in the second end of the piston.

* * * * *